US006427595B1

(12) United States Patent
Van Damme et al.

(10) Patent No.: US 6,427,595 B1
(45) Date of Patent: Aug. 6, 2002

(54) HEAT-SENSITIVE IMAGING ELEMENT FOR MAKING LITHOGRAPHIC PRINTING PLATES COMPRISING POLYMER PARTICLES WITH A SPECIFIC PARTICLE SIZE

(75) Inventors: Marc Van Damme, Heverlee; Joan Vermeersch, Deinze; Frank Louwet, Diepenbeek; Raf Samijn, Wilrijk, all of (BE)

(73) Assignee: Agfa-Gevaert, Mortsel (BE)

( * ) Notice: Subject to any disclaimer, the term of this patent is extended or adjusted under 35 U.S.C. 154(b) by 458 days.

(21) Appl. No.: 08/989,469

(22) Filed: Dec. 12, 1997

Related U.S. Application Data

(60) Provisional application No. 60/038,603, filed on Mar. 6, 1997.

(30) Foreign Application Priority Data

Dec. 19, 1996 (EP) ..... 96203633

(51) Int. Cl.[7] ..... B41N 1/14

(52) U.S. Cl. ..... 101/457; 101/462; 101/467

(58) Field of Search ..... 101/456, 457, 101/462, 465, 466, 467; 430/302; 355/27

(56) References Cited

U.S. PATENT DOCUMENTS

| | | | | | |
|---|---|---|---|---|---|
| 3,476,937 | A | * | 11/1969 | Vrancken | 101/470 |
| 4,004,924 | A | * | 1/1977 | Vrancken et al. | 101/470 |
| 4,496,652 | A | * | 1/1985 | Haugh et al. | 430/569 |
| 5,273,858 | A | * | 12/1993 | Coppens et al. | 430/204 |

FOREIGN PATENT DOCUMENTS

| | | | |
|---|---|---|---|
| WO | 94/18005 | * | 8/1994 |

* cited by examiner

*Primary Examiner*—Stephen R. Funk
(74) *Attorney, Agent, or Firm*—Breiner & Breiner, L.L.C.

(57) ABSTRACT

According to the present invention there is provided a heat-sensitive imaging element for making lithographic printing plates. The heat-sensitive imaging element comprises an image-forming layer comprising hydrophobic thermoplastic polymer particles having a specific particle size and polydispersity for obtaining printing plates with an improved sensitivity, excellent developability, high throughput and less scumming.

9 Claims, No Drawings

HEAT-SENSITIVE IMAGING ELEMENT FOR MAKING LITHOGRAPHIC PRINTING PLATES COMPRISING POLYMER PARTICLES WITH A SPECIFIC PARTICLE SIZE

This application claims benefit of Prov. No. 60/038,603 filed Mar. 6, 1997.

FIELD OF THE INVENTION

The present invention relates to a heat-sensitive imaging element for making a lithographic printing plate. More in particular the present invention relates to a heat-sensitive imaging element comprising an image-forming layer comprising hydrophobic thermoplastic polymer particles having a specific particle size and polydispersity.

BACKGROUND OF THE INVENTION

Lithographic printing is the process of printing from specially prepared surfaces, some areas of which are capable of accepting ink, whereas other areas will not accept ink.

In the art of photolithography, a photographic material is made. imagewise receptive to oily or greasy ink in the photo-exposed (negative working) or in the non-exposed areas (positive working) on an ink-repelling background.

In the production of common lithographic plates, also called surface litho plates or planographic printing plates, a support that has affinity to water or obtains such affinity by chemical treatment is coated with a thin layer of a photosensitive composition. Coatings for that purpose include light-sensitive polymer layers containing diazo compounds, dichromate-sensitized hydrophilic colloids and a large variety of synthetic photopolymers. Particularly diazo-sensitized systems are widely used.

Upon imagewise exposure of such light-sensitive layer the exposed image areas become insoluble and the unexposed areas remain soluble. The plate is then developed with a suitable liquid to remove the diazonium salt or diazo resin in the unexposed areas.

On the other hand, methods are known for making printing plates involving the use of imaging elements that are heat-sensitive rather than photosensitive. A particular disadvantage of photosensitive imaging elements such as described above for making a printing plate is that they have to be shielded from the light. Furthermore they have a problem of stability of sensitivity in view of the storage time and they show a lower resolution. The trend towards heat-sensitive printing plate precursors is clearly seen on the market.

For example, Research Disclosure no. 33303 of January 1992 discloses a heat-sensitive imaging element comprising on a support a cross-linked hydrophilic layer containing thermoplastic polymer particles and an infrared absorbing pigment such as e.g. carbon black. By image-wise exposure to an infrared laser, the thermoplastic polymer particles are image-wise coagulated thereby rendering the surface of the imaging element at these areas ink acceptant without any further development. A disadvantage of this method is that the printing plate obtained is easily damaged since the non-printing areas may become ink-accepting when some pressure is applied thereto. Moreover, under critical conditions, the lithographic performance of such a printing plate may be poor and accordingly such printing plate has little lithographic printing latitude.

EP-A-514145 discloses a heat-sensitive imaging element including a coating comprising core-shell particles having a water insoluble heat softenable core component and a shell component which is soluble or swellable in an aqueous alkaline medium. Red or infrared laser light directed image-wise at said imaging element causes selected particles to coalesce, at least partially, to form an image and the non-coalesced particles are then selectively removed by means of an aqueous alkaline developer. Afterwards a baking step is performed. However the printing endurance of a so obtained printing plate is low.

EP-A-599510 discloses a heat-sensitive imaging element which comprises a substrate coated with (i) a layer which comprises (1) a disperse phase comprising a water-insoluble heat softenable component A and (2) a binder or continuous phase consisting of a component B which is soluble or swellable in aqueous, preferably aqueous alkaline medium, at least one of components A and B including a reactive group or precursor therefor, such that insolubilization of the layer occurs at elevated temperature and/or on exposure to actinic radiation , and (ii) a substance capable of strongly absorbing radiation and transferring the energy thus obtained as heat to the disperse phase so that at least partial coalescence of the coating occurs. After image-wise irradiation of the imaging element and developing the image-wise irradiated plate, said plate is heated and/or subjected to actinic irradiation to effect insolubilization. However the printing endurance of a so obtained printing plate is low.

Furthermore EP-A 952022871.0, 952022872.8, 952022873.6 and 952022874.4 disclose a method for making a lithographic printing plate comprising the steps of (1) image-wise exposing to light a heat-sensitive imaging element comprising (i) on a hydrophilic surface of a lithographic base an image-forming layer comprising hydrophobic thermoplastic polymer particles dispersed in a hydrophilic binder and (ii) a compound capable of converting light to heat, said compound being comprised in said image-forming layer or a layer adjacent thereto; (2) and developing a thus obtained image-wise exposed element by rinsing it with plain water.

The above mentioned heat-sensitive imaging elements for making lithographic printing plates are not optimal regarding sensitivity and developablity.

SUMMARY OF THE INVENTION

It is an object of the present invention to provide a heat-sensitive imaging element for making lithographic printing plates having excellent printing properties, developable in a convenient ecological way.

It is further an object of the present invention to provide a heat-sensitive imaging element for making lithographic printing plates with an improved sensitivity, a high throughput and less scumming.

Further objects of the present invention will become clear from the description hereinafter:

According to the present invention there is provided a heat-sensitive imaging element for making lithographic printing plates comprising on a hydrophilic surface of a lithographic base an image-forming layer comprising hydrophobic thermoplastic polymer particles dispersed in a hydrophilic binder and a compound capable of converting light into heat present in said image-forming layer or a layer adjacent thereto, characterized in that said hydrophobic thermoplastic polymer particles have an average particle size of 40 nm to 150 nm based on the intensity-weighted size distribution and a polydispersity of less than 0.2.

DETAILED DESCRIPTION OF THE INVENTION

It has been found that according to the present invention, using an imaging element as described above, lithographic printing plates with improved sensitivity, excellent developability, high throughput and less scumming can be obtained when said imaging element comprises hydrophobic thermoplastic polymer particles that have an average particle size of 40 nm to 150 nm based on the intensity-weighted size distribution measured with a BI-90 particle Sizer from Brookhaven Instruments Corporation and a polydispersity of less than 0.2. Polydispersity has no units. It is small or close to zero (0.0–0.2) for nearly monodisperse samples or narrow distributions and it is larger for very broad distributions (>0.2). The polydispersity and the average particle size are calculated as described in the manual of the BI-90 Particle Sizer (Catalog Number: BI-9KATMAN, Ver 2.2). More information on laser light scattering and cumulant analysis can be found in the following references: 'Laser Light Scattering', Academic Press, N.Y., 1974; 'Dynamic Light Scattering with Applications to Chemistry, Biology and Physics', Wiley-Interscience, N.Y., 1976; 'Uses and-Abuses of PCS in Particle Sizing' in 'Particle Size Distribution, Assessment and Characterization' ACS Symposium Series 332, 1987; Rev.Sci. Instrum., .62(12), 1991, page 2963; 'Proc. S.P.I.E.', 16, 1993, page 1884; Journal of Chemical Physics, 62, 1975, page 1136.

In the present invention a heat-sensitive imaging element is used comprising on a hydrophilic surface of a lithographic base an image-forming layer comprising hydrophobic thermoplastic polymer particles dispersed in a hydrophilic binder. The hydrophilic binder used in connection with the present invention is preferably not crosslinked or only slightly crosslinked. The imaging element further includes a compound capable of converting light into heat. This compound is comprised in the image-forming layer or a layer adjacent thereto.

According to the present invention it has been found that an imaging element comprising hydrophobic thermoplastic polymer particles with an average particle size of less than 40 nm has decreased developability and increased scumming. Furthermore an imaging element comprising hydrophobic thermoplastic polymer particles with an average particle size of more than 150 nm has decreased sensitivity and a low throughput. Therefor according to the present invention to improve sensitivity, developability and throughput and to avoid scumming an imaging element is provided comprising hydrophobic thermoplastic polymer particles with an average particle size between 40 nm and 150 nm. More preferably the hydrophilic thermoplastic polymer particles are used with an average particle size of 40 nm to 80 nm. Furthermore it has been found that according to the present invention the sensitivity of the imaging element can be improved by using polymer particles that have a polydispersity of less than 0.2.

Furthermore the hydrophobic thermoplastic polymer particles used in connection with the present invention preferably have a coagulation temperature above 50° C. and more preferably above 70° C. Coagulation may result from softening or melting of the thermoplastic polymer particles under the influence of heat. There is no specific upper limit to the coagulation temperature of the thermoplastic hydrophobic polymer particles, however the temperature should be sufficiently below the decomposition temperature of the polymer particles. Preferably the coagulation temperature is at least 10° C. below the temperature at which the decomposition of the polymer particles occurs. When said polymer particles are subjected to a temperature above the coagulation temperature they coagulate to form a hydrophobic agglomerate in the hydrophilic layer so that at these parts the hydrophilic layer becomes insoluble in plain water or an aqueous liquid.

Specific examples of hydrophobic polymer particles for use in connection with the present invention have a polydispersity of less than 0.2 and have a Tg above 80° C. Preferably the polymer particles are selected from the group consisting of polyvinyl chloride, polyvinylidene chloride, polyacrylonitrile, polyvinyl carbazole etc., copolymers or mixtures thereof. Most preferably used are polystyrene, polymethylmethacrylate or copolymers thereof.

The weight average molecular weight of the polymers may range from 5,000 to 5,000,000 g/mol.

The polymer particles are present as a dispersion in the aqueous coating liquid of the image-forming layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation.

The amount of hydrophobic thermoplastic polymer particles contained in the image-forming layer is preferably at least 30% by weight and more preferably at least 45% by weight and most preferably at least 60% by weight.

The image-forming layer can also comprise crosslinking agents although this is not necessary. Preferred crosslinking agents are low molecular weight substances comprising a methylol group such as for example melamine-formaldehyde resins, glycoluril-formaldehyde resins, thiourea-formaldehyde resins, guanamine-formaldehyde resins, benzoguanamine-formaldehyde resins. A number of said melamine-formaldehyde resins and glycoluril-formaldehyde resins are commercially available under the trade names of CYMEL (Dyno Cyanamid Co., Ltd.) and NIKALAC (Sanwa Chemical Co., Ltd.).

The imaging element further includes a compound capable of converting light to heat. This compound is preferably comprised in the image-forming layer but can also be provided in a layer adjacent to the image-forming layer. Suitable compounds capable of converting light into heat are preferably infrared absorbing components although the wavelength of absorption is not of particular importance as long as the absorption of the compound used is in the wavelength range of the light source used for image-wise exposure. Particularly useful compounds are for example dyes and in particular infrared dyes, carbon black, metal carbides, borides, nitrides, carbonitrides, bronze-structured oxides and oxides structurally related to the bronze family but lacking the A component e.g. $WO_{2.9}$. It is also possible to use conductive polymer dispersion such as polypyrrole or polyaniline-based conductive polymer dispersions. The lithographic performance and in particular the print endurance obtained depends on the heat-sensitivity of the imaging element. In this respect it has been found that carbon black yields very good and favorable results.

A light-to-heat converting compound in connection with the present invention is most preferably added to the image-forming layer but at least part of the light-to-heat converting compound may also be comprised in a neighbouring layer.

The lithographic base according to the present invention can be aluminum e.g. electrochemically and/or mechanically grained and anodized aluminum.

Furthermore in connection with the present invention, the lithographic base can also comprise a flexible support, such as e.g. paper or plastic film, provided with a cross-linked hydrophilic layer. A particularly suitable cross-linked rough hydrophilic layer may be obtained from a hydrophilic binder cross-linked with a cross-linking agent such as formaldehyde, glyoxal, polyisocyanate or preferably a hydrolysed tetra-alkylorthosilicate.

As hydrophilic binder there may be used hydrophilic (co)polymers such as for example, homopolymers and copolymers of vinyl alcohol, acrylamide, methylol acrylamide, methylol methacrylamide, acrylic acid, methacrylic acid, hydroxyethyl acrylate, hydroxyethyl methacrylate or maleic anhydride/vinylmethylether copolymers.

A cross-linked hydrophilic layer on a flexible support used in accordance with the present embodiment preferably also contains substances that increase the mechanical strength and the porosity of the layer e.g. colloidal silica. In addition inert particles of larger size than the colloidal silica can be added e.g. silica prepared according to Stöber as described in J. Colloid and Interface Sci., Vol. 26, 1968, pages 62 to 69 or alumina particles or particles having an average diameter of at least 100 nm which are particles of titanium dioxide or other heavy metal oxides. Incorporation of these particles gives the surface of the cross-linked hydrophilic layer a uniform rough texture consisting of microscopic hills and valleys.

The thickness of the cross-linked hydrophilic layer may vary in the range of 0.2 to 25 $\mu$m and is preferably 1 to 10 $\mu$m.

Particular examples of suitable cross-linked hydrophilic layers for use in accordance with the present invention are disclosed in EP-A 601240, GB-P-1419512, FR-P-2300354, U.S. Pat. No. 3971660, U.S. Pat. No. 4284705 and EP-A 514490.

As flexible support of a crosslinked hydrophilic layer in connection with the present embodiment it is particularly preferred to use a plastic film e.g. substrated polyethylene terephthalate film, polyethylene naphthalate film, cellulose acetate film, polystyrene film, polycarbonate film etc . . . The plastic film support may be opaque or transparent.

It is particularly preferred to use a polyester film support to which an adhesion improving layer has been provided. Particularly suitable adhesion improving layers for use in accordance with the present invention comprise a hydrophilic binder and colloidal silica as disclosed in EP-A 619524, EP-A 620502 and EP-A 619525.

Optionally, there may be provided one or more intermediate layers between the hydrophilic support and the image-forming layer. An image-forming layer in connection with the present invention comprises thermoplastic polymer particles dispersed in a hydrophilic binder.

Suitable hydrophilic binders for use in an image-forming layer in connection with this invention are water soluble (co)polymers for example synthetic homo- or copolymers such as polyvinylalcohol, a poly(meth)acrylic acid, a poly (meth)acrylamide, a polyhydroxyethyl(meth)acrylate, a polyvinylmethylether or natural binders such as gelatin, a polysaccharide such as e.g. dextran, pullulan, cellulose, arabic gum, alginic acid.

The hydrophilic binder can also be a water insoluble, alkali soluble or swellable resin having phenolic hydroxy groups and/or carboxyl groups.

Preferably the water insoluble, alkali soluble or swellable resin used in connection with the present invention comprises phenolic hydroxy groups. Suitable water insoluble, alkali soluble or swellable resins for use in an image-forming layer in connection with this invention are for example synthetic novolac resins such as ALNOVOL, a registered trade mark of Reichold Hoechst and DUREZ, a registered trade mark of OxyChem and synthetic polyvinylfenols such as MARUKA LYNCUR M, a registered trade mark of Dyno Cyanamid.

The hydrophilic binder used in connection with the present invention is preferably not cross-linked or only slightly cross-linked.

In accordance with the present invention the imaging element is image-wise exposed and subsequently developed with an aqueous solution.

Image-wise exposure in connection with the present invention is preferably an image-wise scanning exposure involving the use of a laser or L.E.D. Preferably used are lasers that operate in the infrared or near-infrared, i.e. wavelength range of 700–1500 nm. Most preferred are laser diodes emitting in the near-infrared.

According to a method in connection with the present invention for obtaining a printing plate, the imaging element is image-wise exposed and subsequently developed by rinsing it with plain water before mounting the imaging element on the printing press.

According to a further method, the imaging element is first mounted on the printing cylinder of the printing press and then image-wise exposed directly on the press. Subsequent to exposure, the imaging element can be developed by wiping the image-forming layer with e.g. a cotton pad or sponge soaked with water to remove the non-image forming areas.

The printing plate of the present invention can also be used in the printing process as a seamless sleeve printing plate. In this option the printing plate is soldered in a cylindrical form by means of a laser. This cylindrical printing plate which has as diameter the diameter of the print cylinder is slided on the print cylinder instead of applying in a classical way a classically formed printing plate. More details on sleeves are given in "Grafisch Nieuws" , 15, 1995, page 4 to 6.

After the development of an image-wise exposed imaging element with an aqueous solution and drying the obtained plate can be used as a printing plate as such. However, it is still possible to bake said plate at a temperature between 100° C. and 330° C. for a period of 10 minutes to 1 minute.

The following example illustrates the present invention without limiting it thereto. All parts and percentages are by weight unless otherwise specified.

EXAMPLE

Preparation of the Lithographic Base

A 0.15 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 A/m$^2$ to form a surface topography with an average center-line roughness Ra of 0.5 $\mu$m.

After rinsing with demineralized water the aluminum foil was then etched with an aqueous solution containing 300 g/l of sulfuric acid at 60° C. for 180 seconds and rinsed with demineralized water at 25° C. for 30 seconds.

The foil was subsequently subjected to anodic oxidation in an aqueous solution containing 200 g/l of sulfuric acid at a temperature of 45° C., a voltage of about 10 V and a current density of 150 A/m$^2$ for about 300 seconds to form an anodic oxidation film of 3.00 g/m$^2$ of $Al_2O_3$, then washed with demineralized water, posttreated with a solution containing 20 g/l of sodium bicarbonate at 40° C. for 30 seconds, subsequently rinsed with demineralized water at 20° C. during 120 seconds and dried.

The grained and anodized lithographic base was then submersed in an aqueous solution containing 5 % w/w of citric acid for 60 seconds, brought at pH 7 with an aqueous solution of sodium hydroxyde 2N for 60 seconds, rinsed with demineralized water and dried at 25° C.

Preparation of the Coating Composition for the Recording Layer

To 130 g of a 20% w/w dispersion of polymethyl methacrylate latex (see table 1) in water was subsequently added, while stirring, 50 g of a 15% w/w dispersion of carbon black containing a wetting agent in water, 500 g of water, 320 g of a 2% w/w solution of a 98% hydrolyzed polyvinylacetate, having a weight average molecular weight of 200,000 g/mol (MOWIOL 56-98 available from Hoechst) in water.

Preparation of the Imaging Element

An imaging element according to the invention was produced by preparing the above described coating composition for the infrared recording layer, coating it onto the above described lithographic base in an amount of 30 g/m$^2$ (wet coating amount) and drying it at 36° C.

Preparation of the Printing Plate and Making Copies Thereof

The imaging elements 1 to 7 were subjected to a scanning infrared NdYlf laser diode emitting at 1064 nm (scanspeed 4.4 m/s, spot size 151$\mu$ and a varying power on the plate of 75 to 540 mW).

After imaging the plates were processed with plain water. The obtained lithographic printing plates were used to print in an identical way on a conventional offset press using a commonly employed ink and fountain. The sensitivity and scumming of these printing plates is listed in table 1.

TABLE 1

| Example | Latex-type | Particle size (nm) | Sensitivity* | Scumming |
|---|---|---|---|---|
| 1 | PMMA | 35 nm | N.M* | Yes |
| 2 | PMMA | 69 nm | 260 mW | No |
| 3 | PMMA | 100 nm | 380 mW | No |
| 4 | PMMA | 114 nm | 475 mW | No |
| 5 | PMMA | 143 nm | 475 mW | No |
| 6 | PMMA | 172 nm | 540 mW | No |
| 7 | PMMA | 281 nm | >540 mW | No |

* N.M.: The printing plate could not be developed and the sensitivity was not measurable

* Sensitivity : The minimum power for reproducing a single scan line at a speed of 4.4 m/s is given as a value for the infrared sensitivity of the printing plate. The lower this value, the higher the sensitivity. The minumum sensitivity for an acceptable throughput should be ≦475 mW.

*All the latex types listed in table 1 have a polydispersity <0.15. The average particle size based on the intensity-weighted size distribution was measured with a BI-90 particle Sizer from Brookhaven Instruments Corporation.

What is claimed is:

1. A method for making a lithographic printing plate comprising the steps of:

(1) image-wise exposing to light of a laser that operates in infrared or near-infrared an imaging element comprising (i) on a hydrophilic surface of a lithographic base an image forming layer comprising hydrophobic thermoplastic polymer particles, said hydrophobic polymer particles having an average particle size of 40 nm to 150 nm based on an intensity-weighted size distribution and a polydispersity of less than 0.2 and (ii) a compound capable of converting light to heat, said compound being in said image forming layer or a layer adjacent thereto;

(2) and developing a thus obtained image-wise exposed imaging element by rinsing it with plain water or an aqueous liquid.

2. A method according to claim 1 wherein said hydrophobic thermoplastic polymer particles have an average particle size of 40 nm to 80 nm.

3. A method according to claim 1 wherein said polymer particles are selected from the group consisting of polymethylmeth-acrylate, polystyrene or copolymers thereof.

4. A method according to claim 1 wherein said imaging element comprises on said hydrophilic surface of said lithographic base said image-forming layer comprising said hydrophobic thermoplastic polymer particles dispersed in a hydrophilic binder present in said image-forming layer or a layer adjacent thereto.

5. A method according to claim 4 wherein said hydrophilic binder is a water soluble or swellable (co)polymer.

6. A method according to claim 1 wherein said hydrophobic thermoplastic polymer particles have a coagulation temperature of at least 50° C.

7. A method according to claim 1 wherein said lithographic base is anodized aluminum or comprises a flexible support having thereon a crosslinked hydrophilic layer.

8. A method for making a lithographic printing plate comprising the steps of:

(1) image-wise exposing to light of a laser that operates in infrared or near-infrared an imaging element comprising (i) on a hydrophilic surface of a lithographic base an image forming layer comprising hydrophobic thermoplastic polymer particles dispersed in a hydrophilic binder said hydrophobic polymer particles have an average particle size of 40 nm to 150 nm based on an intensity-weighted size distribution and a polydispersity of less than 0.2 and (ii) a compound capable of converting light to heat, said compound being comprised in said image forming layer or a layer adjacent thereto;

(2) developing a thus obtained image-wise exposed imaging element with plain water or an aqueous liquid;

(3) aid overall heating a thus obtained imaged element.

9. A method for making a lithographic printing plate comprising the steps of:

(1) mounting an imaging element comprising (i) on a hydrophilic surface of a lithographic base an image forming layer comprising hydrophobic thermoplastic polymer particles capable of coalescing under the influence of heat and dispersed in a hydrophilic binder said hydrophobic polymer particles having an average particle size of 40 nm to 150 nm based on an intensity-weighted size distribution and a polydispersity of less than 0.2 and (ii) a compound capable of converting light to heat, said compound being comprised in said image forming layer or a layer adjacent thereto on a print cylinder of a printing press;

(2) image-wise exposing said imaging element to light that operates in infrared or near-infrared region by means of a laser or a LED;

(3) and developing a thus obtained image-wise exposed imaging element by supplying an aqueous dampening liquid to said image forming layer while rotating said print cylinder.

* * * * *

UNITED STATES PATENT AND TRADEMARK OFFICE

CERTIFICATE OF CORRECTION

PATENT NO. : 6,427,595 B1 
DATED : August 6, 2002
INVENTOR(S) : Marc Van Damme et al.

It is certified that error appears in the above-identified patent and that said Letters Patent is hereby corrected as shown below:

Column 1,
Line 23, "made. imagewise" should read -- made imagewise --.

Column 8,
Line 42, "(3) aid" should read -- (3) and --.

Signed and Sealed this

Eleventh Day of February, 2003

JAMES E. ROGAN
*Director of the United States Patent and Trademark Office*